US007314092B2

(12) United States Patent
Telfer

(10) Patent No.: US 7,314,092 B2
(45) Date of Patent: Jan. 1, 2008

(54) PACKER

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 239 days.

(21) Appl. No.: 10/514,695

(22) PCT Filed: May 20, 2003

(86) PCT No.: PCT/GB03/02183

§ 371 (c)(1),
(2), (4) Date: Jun. 10, 2005

(87) PCT Pub. No.: WO03/097993

PCT Pub. Date: Nov. 27, 2003

(65) Prior Publication Data

US 2005/0230125 A1 Oct. 20, 2005

(30) Foreign Application Priority Data

May 21, 2002 (GB) ..... 0211601.0

(51) Int. Cl.
*E21B 33/12* (2006.01)

(52) U.S. Cl. ..... 166/387; 166/196

(58) Field of Classification Search ..... 166/387, 166/196, 180, 181, 191
See application file for complete search history.

(56) References Cited

U.S. PATENT DOCUMENTS

| | | | |
|---|---|---|---|
| 2,186,324 | A | 1/1940 | Brown |
| 2,243,967 | A | 6/1941 | Layne et al. |
| 2,878,876 | A | 3/1959 | Long |
| 4,537,251 | A | 8/1985 | Braddick |
| 4,972,908 | A | 11/1990 | Braddick |

FOREIGN PATENT DOCUMENTS

| | | |
|---|---|---|
| WO | WO 01/83938 | 11/2001 |

*Primary Examiner*—David Bagnell
*Assistant Examiner*—Giovanna M Collins
(74) *Attorney, Agent, or Firm*—C. Dean Domingue; Robert L. Waddell; Ted M. Anthony

(57) ABSTRACT

A packer tool for mounting on a work string in an oil and/or gas well is described. The packer is of the compression set type but includes a mechanism to prevent premature setting in the well. A method of running the tool with the completion is provided in order to advantageously allow an integrity test to be performed on the same run.

29 Claims, 2 Drawing Sheets

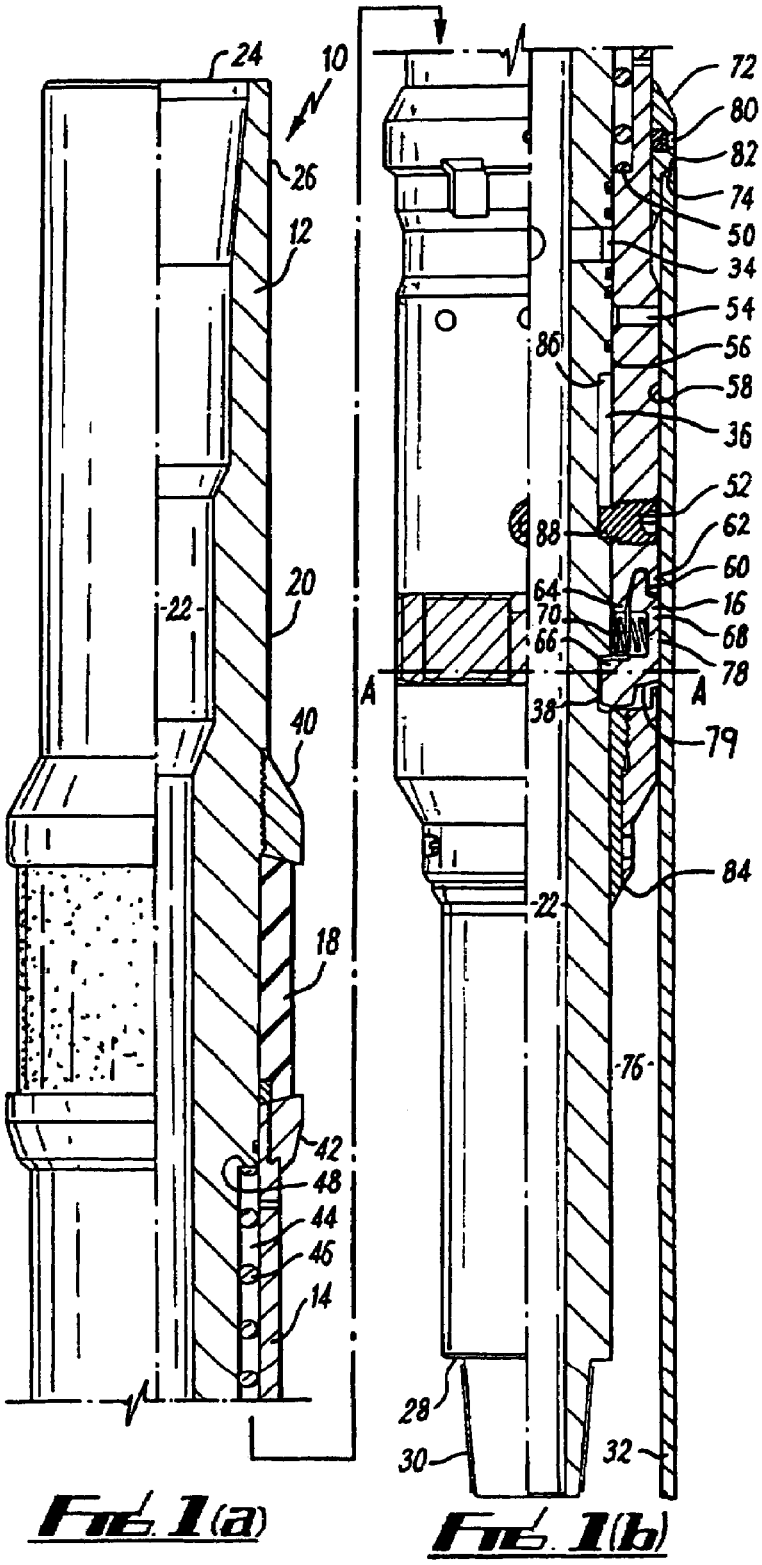
FIG. 1(a)
FIG. 1(b)
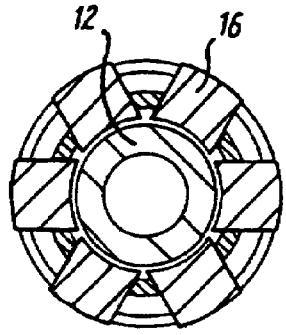
FIG. 2

PACKER

CROSSREFERENCE TO RELATED APPLICATIONS

This patent application claims an international filing date of 20 May 2003 and a priority date of 21 May 2003 and a priority date of 21 May 2002.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The present invention relates to a downhole packer for use in a well bore. More particularly, the present invention relates to a packer which can be used for downhole testing.

During well completions it is desirable to check the integrity of the production bore and any packers used to isolate portions of the well. A known technique for this is to perform an inflow or negative test. One or more packers are inserted into the well bore to seal off a portion of the well. Low density fluid is introduced to the work string reducing hydrostatic pressure within the pipe. As a consequence of the drop in hydrostatic pressure, well bore fluid flows through any cracks or irregularities into the bore resulting in an increase in pressure which can be monitored and used to indicate where repairs are necessary.

Typically, a separate trip is required to be made into the well to perform an inflow or negative pressure test. This is because the conventional packer tools used are set by a relative rotation within the well bore. As many other tools are activated by rotation it is likely that the packer would prematurely set. This problem has been overcome by the introduction of a weight set packer. Such a weight set packer, referred to as a compression set packer, is disclosed in the Applicant's International Patent Application, publication no. WO/0183938. The packer is set by a sleeve moveable on a body of the packer being set down on a formation in the well bore. Movement of the sleeve compresses one or more packing elements to provide a seal.

This compression set packer is particularly suitable for integrity testing of a completion when a permanent packer, or 'tieback' packer, with a Polished Bore Receptacle (PBR) has been used. Once the permanent packer with the PBR has been set, a single trip can be made into the well to operate clean-up tools and perform an in-flow or negative test. The clean-up tools may be operated by relative rotation of the work string in the well-bore and further the work string can be slackened off so that the sleeve of the compression set packer lands out on the PBR. This sets the compression set packer above the PBR and seals the bore between the packers. An in-flow or negative test can then be performed.

A significant disadvantage of this compression set packer is that if the sleeve contacts a surface prior to reaching the PBR, the packer can be prematurely set. Additionally, as the work string requires to move through the bore relative to the sleeve for compression to occur, the compression set packer cannot be run on the same string as the tieback packer and PBR.

It is an object of the present invention to provide a compression set packer which includes a mechanism to prevent premature setting of the packer in a well bore.

It is a further object of at least one embodiment of the present invention to provide a packer which can be run with a tubular in a well bore to seal above the tubular when the tubular is positioned in the well bore.

It is a further object of at least one embodiment of the present invention to provide a method of performing an in-flow test in a well bore on the same trip as setting a tieback packer including a polished bore receptacle.

BRIEF SUMMARY OF THE INVENTION

According to a first aspect of the present invention there is provided a packer tool for mounting on a work string, the packer tool comprising a body with one or more packer elements and a sleeve, the packer tool being set by movement of the tool body relative to the sleeve compressing the one or more packer elements, wherein the sleeve includes at least one retaining member, the at least one retaining member being moveable between first and second positions, the first position preventing movement of the sleeve relative to the tool body and the second position releasing the tool body while providing means for arresting movement of the sleeve so that the tool can be set.

Preferably the/each retaining member is located in an aperture between an inner and an outer surface of the sleeve. Preferably a first portion of the/each retaining member protrudes from the aperture in the first position. Preferably also a second portion of the/each retaining member protrudes from the aperture in the second in the second position. Preferably also the sleeve includes restraining lips or overhangs on the inner and outer surfaces at the/each aperture to limit movement of the/each retaining member as it protrudes from the aperture.

Preferably the retaining member is a sprung dog. Preferably a spring of the/each dog biases the/each dog to the second position. In the first position the dog may protrude from the inner surface of the sleeve and in the second position the dog may protrude from the outer surface of the sleeve.

Advantageously the tool body includes at least one recess on an outer surface. Preferably the/each retaining member locates in the/each recess in the first position. By locating in a recess of the tool body, the/each retaining member effectively locks the sleeve and tool body together preventing movement of the sleeve relative to the tool body.

Preferably also the second portion of the/each retaining member includes a contact surface. The contact surface may engage a formation in the well bore when the/each retaining member is in the second position. Thus the contact surface of the/each retaining member can be landed on a formation in a well bore. Pressure upon the/each retaining member is then transferred to the sleeve. When the work string is slackened off the tool body will then move relative to the sleeve and thereby set the packer.

Advantageously when the packer is run in the well bore, the/each sprung dog is held in the first position such that the packer cannot be set. When the packer is located above the required formation, the/each dog is released and the spring within the/each dog will bias the dog into the second position ready to be landed on the formation and set the packer.

Preferably also the tool body and the sleeve include one or more ports. Advantageously the ports are aligned when the packer is set to allow the passage of fluid from the outer surface of the sleeve to a throughbore of the tool body. More preferably the throughbore is connected to a throughbore of the work string. Preferably also the tool body and the sleeve are keyed together to limit longitudinal movement and prevent rotational movement of the sleeve relative to the tool body. The tool body and the sleeve may be keyed via a longitudinal slot on the outer surface of the tool body and a pin on the inner surface of the sleeve.

Preferably also biasing means are located between the tool body and the sleeve. In setting the packer the sleeve may move against the biasing means. The biasing means may be a spring.

Further the packer may include a shoulder on an outer surface. More preferably the shoulder is located on the outer surface of the sleeve. The shoulder provides an abutment surface for a tubular if located at the packer tool. The tubular may be used to hold the retaining member in the first position. Preferably the tubular is a polished bore receptacle.

According to second aspect of the present invention there is provided a method of setting the packer tool of the first aspect in a well bore, the method comprising the steps:

(a) locating the packer tool on a work string and abutting a shoulder of the tool on a top of a tubular being run in the well bore;
(b) using the tubular to hold a retaining member of the packer tool in a first position preventing movement of a sleeve of the tool relative to a body of the tool;
(c) running the tool and tubular into a well bore;
(d) detaching the work string from the tubular and raising the tool relative to the tubular;
(e) locating the retaining member above the top of the tubular so that it moves to a second position releasing the tool body and providing a contact surface; and
(f) landing the contact surface on the top of the tubular so that the sleeve is arrested and movement of the tool body compresses packing elements on the body which set the tool.

Running the tool with the retaining member in the first position prevents the tool from prematurely setting. Additionally as it is the tubular, which may be a polished bore receptacle, which is used to hold the tool in the first position, setting of the packer will only be achieved at the top of the tubular as desired.

According to a third aspect of the present invention there is provided a method of performing an integrity test on a well completion, the method comprising the steps:

(a) locating a retrievable packer at a polished bore receptacle of a tieback packer on a work string;
(b) running the work string in a well bore;
(c) setting the tieback packer at a desired location within the well bore;
(d) setting the retrievable packer to isolate a section of the well bore;
(e) circulating a light density fluid through the work string and monitoring the pressure to determine the integrity; and
(f) removing the work string and retrievable packer from the well bore.

Preferably the integrity test is an in-flow or negative pressure test as is known in the art.

Preferably the step of setting the retrievable packer includes the step of setting down the retrievable packer on the polished bore receptacle.

Preferably also the method includes the step of detaching the work string from the tieback packer and polished bore receptacle prior to setting the retrievable packer.

More preferably the method includes the step of pulling up the work string after setting the tieback packer and before setting the retrievable packer.

Preferably the retrievable packer is a compression set packer.

Advantageously, the compression set packer is according to the first aspect.

BRIEF DESCRIPTION OF THE DRAWINGS

An example embodiment of the invention will now be illustrated with reference to the following Figures in which:

FIGS. 1(*a*) and (*b*) show a part cross sectional schematic view of a packer tool according to the present invention;

FIG. 2 shows a sectional view through section A-A' of the tool of FIG. 1.

DETAILED DESCRIPTION OF THE INVENTION

Figure 3:
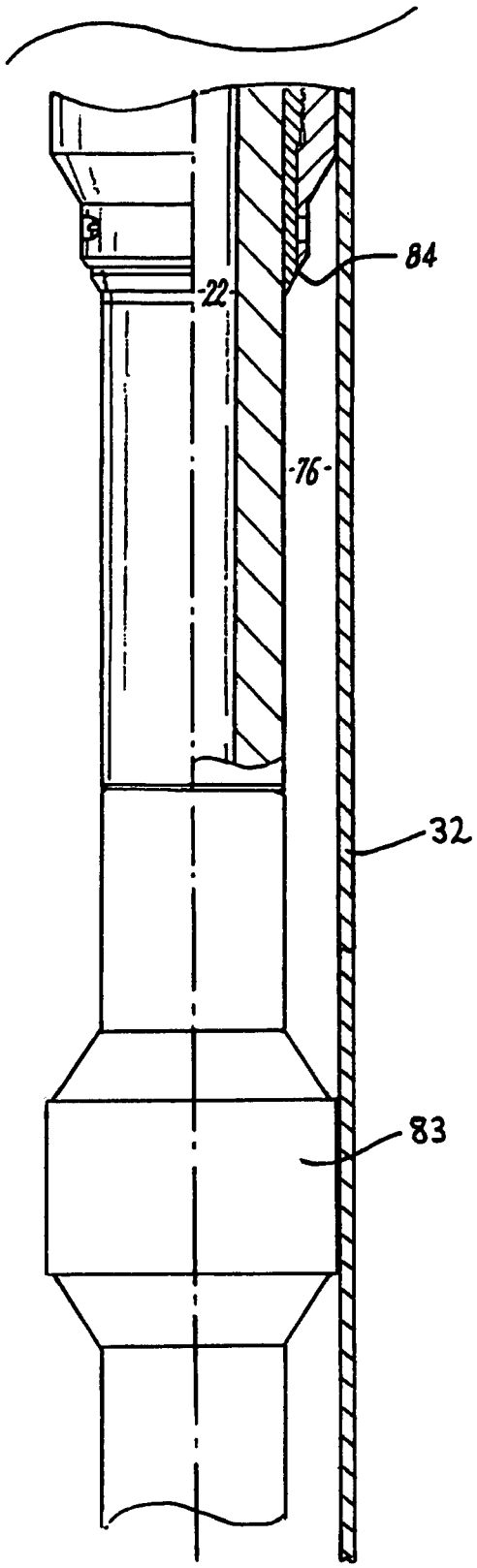
FIG. 3 is a partial sectional view of a lower part of the packer tool of FIG. 1, shown coupled to a tieback packer.

Reference is initially made to FIG. 1 of the drawings which illustrates a packer tool, generally indicated by reference numeral 10, according to the present invention. Packer tool 10 is a compression set packer.

The packer tool 10 comprises a body 12 upon which is arranged a packing element 18 and a sleeve 14. Packing element 18 is the form of an annular band of rubber which when compressed longitudinally will expand radially, increasing the overall diameter of the tool 10 to provide a seal between the outer surface 20 of the body 12 and a surface within a well bore (not shown). Packer tool 10 further includes dogs 16 circumferentially arranged around the body 12 within the sleeve 14.

Tool body 12 is a cylindrical mandrel including a throughbore 22. At an upper end 24, there is located a box section 26 to allow the body 12 to be connected to a work string (not shown). At a lower end 28 of the body 12 there is located a pin section 30 so that the tool 10 can be mounted within a work string (not shown). The work string located at the bottom 28 of the tool 10 preferably supports a packer and a tubular shown in part at 32. It will be understood that the tubular 32 can be of any form, for example liner or casing. The top 74 of the tubular 32 may referred to as a liner top or liner lap. In the preferred embodiment tubular 32 is a polished bore receptacle and the packer is a tieback packer providing a permanent seal below the top 74.

The body 12 further includes a port 34 providing a radial aperture from the throughbore 22 to the outer surface 20. Further on the outer surface 20 is arranged a longitudinal slot 36 and six recesses 38, the recesses being arranged circumferentially around the body 12. The purpose of each of these will be described hereinafter.

Mounted on the body 12 is a shoulder 40 against which is arranged the packer element 18. A second shoulder 42 is located on the sleeve 14 adjacent the packer element 18. Shoulders 40 and 42 contain the packer element 18 and if moved toward each other will provide the necessary compression for the subsequent radial expansion of the element 18 which sets the tool 10.

The sleeve 14 is arranged around the body 12 and a recess 44 is formed there between. Within recess 44 is located a bias spring 46. Bias spring 46 is limited in longitudinal movement between a face 48 on the body 12 and a face 50 on the sleeve 14. When the faces 48,50 are moved together as the body 12 and the sleeve 14 are moved relative to each other, the spring 46 will be compressed and allow the packer element 18 to expand. The spring 46 will bias the packer element 18 to an uncompressed state. Recess 44 is limited in size by the movement of a retaining stud 52 located through the sleeve 14 which protrudes into the slot 36 on the tool body 12. The retaining stud 52 allows the body 12 and the sleeve 14 to move relative to each other over an axial distance dictated by the length of the slot 36. Slot 36 is selected to provide a sufficient length against which suitable compression of the packing element 18 of the tool 10 can be achieved.

Sleeve 14 includes a port 54 which provides fluid access from an inner surface 56 to the outer surface 58 of the sleeve 14. Port 54 can be arranged to align with the port 34 of the tool body 12 so that there is a passage of fluid from the throughbore 22 to the outer surface 58 of the sleeve 14 and consequently the tool 10.

Further apertures 60 are located through the sleeve 14. There are six apertures 60 in the preferred embodiment. This is best illustrated in FIG. 2. However, any number of apertures may be used and, for clarity, only one will be described here. Located in aperture 60 is a sprung dog 16 which may be considered as a retaining member as it is contained within the sleeve 14. Retention of sprung dog 16 is provided by a first lip 62, arranged on the outer surface 58 of the sleeve 14, and a second lip 64, on the inner surface of the sleeve 14. Sprung dog 16 is held between the overhangs of the lips 62, 64 and allows the dog 16 to move within the aperture 60 so that it may protrude from the inner 56 or outer 58 surface of the sleeve 14.

In a first position, a first portion 66 of the dog 16 protrudes from the inner surface 56 into recess 38 on the body 12. In a second position, a second portion 68 of the dog 16 may protrude through the outer surface 58 of the sleeve 14. In FIG. 1 the tool 10 is shown in the first position, where the first portion 66 is contained within recess 38 and the second portion 68 is enclosed in the aperture 60. The dog 16 is held in the first position by virtue of the second portion 68 contacting the tubular 32. As can be seen from the Figure the diameter of the tool 10 is selected to match the inner diameter of the tubular 32.

Dog 16 further comprises a spring 70 used to bias the dog 16 into the second position, that is having the second portion 68 protruding from the outer surface 58 of the sleeve 14. This would occur if tool 10 were removed from the tubular 32. The first portion 66 would be moved into the aperture 60 while the second portion 68 moves radially outwards to expose a surface 78 substantially perpendicular to the axis of the tool 10.

Mounted on the sleeve 14 above the dogs 16 is a ring 72. Ring 72 is fixed to sleeve 14 via a grub screw 80 and provides a surface 82 for abutment to the top 74 of the tubular 32. When abutted, the ring 72 prevents debris entering the annulus 76 between the tool 10 and the tubular 32.

In use, tool 10 is mounted on a work string via the box section 26 and pin 30. The work string will also support a tubular 32, which is preferably a polished bore receptacle. In an embodiment a tieback packer 83, shown in FIG. 3, is located on the work string below the tool also. Packer tool 10 is positioned on the string so that the surface 82 of ring 72 abuts the top 74 of the tubular 32. In this way the tubular 32 may provide support to the tool 10. Additionally the dogs 16 are located within the tubular 32.

Initially, by virtue of the tubular 32 contacting the second portion 68 of the dog, the first portion 66 of the dog 16 will protrude from the inner surface 56 of the sleeve 14 into the recess 38 of the body 12. As the dog 16 breaches the body 12 and the sleeve 14 at the recess 38, neither the body 12 nor the sleeve 14 can move independently of the other. The dog 16 has effectively locked them together. The sleeve 14 and body 12 cannot rotate relative to each other by virtue of the dog 16 and the stud 52 located in the longitudinal slot 36.

The tool 10 is run into the well bore in this first position. As the leading edge 84 of the sleeve 14 is held within the tubular 32, the edge 84 is prevented from contacting anything within the well bore which would put pressure on the sleeve and want the packer to set. More preferably, if anything in the well bore contacts the sleeve above the tubular, the shoulder 42 is prevented from moving by virtue of the dog 16 being located within recess 38 of the tool body so that it is impossible for the packing element 18 to be compressed in any way to prematurely set the tool 10.

When tubular 32 is positioned in the well bore, the work string is rotated to release the tool 10 from the tieback packer and tubular 32. As the packer tool 10 is not set by rotation but by weight, the packing element 18 will not be compressed and therefore the tool cannot set during this operation. The work string carrying the tool 10 can then be raised, pulling the tool 10 out of the tubular 32. As the packer tool 10 is raised relative to the tubular 32, the dogs 16 will reach a position above the top 74 of the tubular 32. At this location, the tubular 32 will no longer hold the dogs 16 against the body 12 and consequently the springs 70 of the dogs 16 will bias the dogs radially outwards and a second portion 68 of each dog 16 will now extend past the outer surface 58 of the sleeve 14. The perpendicular surface 78 of each dog 16 will now extend outwards from the sleeve 14. The packer tool 10 is not set by this lifting operation as the bias spring 46 located in the recess 44 between the body 12 and the sleeve 14 is biased such that the packer element 18 is in an extended position.

Once the dog 16 is released at the top of the tubular 32 the tool 10 can be set down by slackening weight on the work string. When the work string is slackened off the tool will fall to a position where a surface 79 of the dog 16 contacts the top 74 of the tubular 32. Contact of the surface 79 on the top 74 will arrest the sleeve 14 by virtue of the holding position maintained by each dog 16. With the sleeve 14 now held in position at the top 74 of the tubular 32, all weight exerted on the work string will bear upon the tool body 12. The tool body 12 will be forced down through the sleeve 14 and the tubular 32 which will thereby compress the bias springs 46 and cause the longitudinal slot 36 in the body 12 to move over the stud 52. Movement of the body 12 relative to the sleeve 14 will cause the shoulder 40 on the body 12 to move towards the shoulder 42 on the sleeve 14, thereby compressing the spring 46 and the packing element 18. Compression of element 18 sets the tool as the element 18 will seal against the well bore or casing/liner if in place. Excessive pressure cannot be applied to the element 18 by virtue of the stud 52 reaching an end 86 of the slot 36.

This is considered as the second position of the tool 10. In this position the port 34 in the body is aligned with the port 54 in the sleeve 14. Fluid may then flow from the well bore to the throughbore of the work string.

To retrieve the packer tool 10, the work string is simply pulled out of the well bore. As weight is removed from the body 12, surface 48 of the body 12 is raised away from surface 50 of the sleeve 14. This is assisted by the bias spring 46. At the same time, the slot 36 will pass over the stud 52 until the stud locates in a lower end 88 of the slot. This movement releases compression on the packer element 18 and the element 18 will be pulled back to release from the well bore and break the seal. The packer tool 10 can then be removed from the well bore on the work string as the sleeve will be supported on the body by the stud 52.

In order to conduct an in-flow or negative pressure test on a completion, the tool is operated as is described herein above with a tieback packer 83 and polished bore receptacle mounted on the work string below the packer tool 10. The polished bore receptacle will hold the dogs 16 in the first position to prevent the body 12 and sleeve 14 from moving relative to each other and thereby the packer tool cannot prematurely set. The ring 72 will prevent debris entering the polished bore receptacle particularly if cleaning tools are used on the work string above the packer tool 10.

As described above, once the polished bore receptacle is fixed in the well bore and the tieback packer has been expanded to seal below the packer tool 10, the packer tool 10 can be raised and provides a seal in the well bore above the polished bore receptacle. This seal will be against a casing or liner in the well bore. A light density fluid can be pumped through the work string and circulated in the well bore. The pressure within the throughbore 22 will be lower than the pressure in the annulus 76 and consequently between the polished bore receptacle and the casing/liner. As a result, any cracks or leaks in the casing/liner or through the tieback packer will cause well fluid, which will be at a higher pressure than the light density fluid in the throughbore 22, to move into the throughbore 22. The leaked fluid will enter the throughbore through the ports 34, 54 which when packer tool 10 is set will align to provide a single radial bore. The higher pressure fluid entering the throughbore will increase the pressure in the throughbore 22 which can be monitored on the surface of the well bore and used to provide an indication of the integrity of the completion. Once the test is complete the packer tool 10 can be retrieved from the well as described herein above.

The principle advantage of the present invention is that it provides a packer tool which can be run with the completion to allow an integrity test to be performed without the need to make a dedicated run into the well for testing.

A further advantage of the present invention is that it provides a retrievable packer tool which includes a mechanism to prevent the packer tool from prematurely setting in a well bore.

Various modifications may be made to the invention herein described without departing from the scope thereof. In particular, it will be appreciated that any number of sprung dogs, studs and slots, and radial ports may be incorporated in the tool. Additionally although the tool is described, in use, in a vertical well bore, the tool may be used in inclined or horizontal bores.

The invention claimed is:

1. A packer tool for mounting on a work string, the packer tool comprising a body with one or more packer elements and a sleeve, the packer tool being set by movement of the tool body relative to the sleeve compressing the one or more packer elements;

wherein the sleeve includes at least one retaining member, the at least one retaining member being moveable between first and second positions;

and wherein, in the first position, the at least one retaining member prevents movement of the sleeve relative to the tool body to prevent setting of the packer tool;

and further wherein, in the second position, the at least one retaining member releases the tool body and defines means for arresting movement of the sleeve, to facilitate compression of the one or more packer elements so that the tool can be set.

2. A packer tool as claimed in claim 1 wherein the/each retaining member is located in an aperture between an inner and an outer surface of the sleeve.

3. A packer tool as claimed in claim 2 wherein a first portion of the/each retaining member protrudes from the aperture in the first position.

4. A packer tool as claimed in claim 2 wherein a second portion of the/each retaining member protrudes from the aperture in the second position.

5. A packer tool as claimed in claim 4 wherein the second portion of the/each retaining member includes a contact surface to engage a formation in the well bore when the/each retaining member is in the second position.

6. A packer tool as claimed in claim 2 wherein the sleeve includes restraining lips or overhangs on the inner and outer surfaces at the/each aperture to limit movement of the/each retaining member as it protrudes from the aperture.

7. A packer tool as claimed in claim 1 wherein the/each retaining member is a sprung dog.

8. A packer tool as claimed in claim 7 wherein a spring of the/each dog biases the/each dog to the second position.

9. A packer tool as claimed in claim 1 wherein the tool body includes at least one recess on an outer surface into which is located the/each retaining member in the first position.

10. A packer tool as claimed in claim 1 wherein the tool body and the sleeve include one or more ports which are aligned when the packer is set to allow the passage of fluid from an outer surface of the sleeve to a throughbore of the tool body.

11. A packer tool as claimed in claim 1 wherein the tool body and the sleeve are keyed together to limit longitudinal movement and prevent rotational movement of the sleeve relative to the tool body.

12. A packer tool as claimed in claim 1 wherein biasing means are located between the tool body and the sleeve.

13. A packer tool as claimed in claim 1 wherein the packer tool includes a shoulder on an outer surface.

14. A packer tool as claimed in claim 13 wherein the shoulder is located on the outer surface of the sleeve.

15. A method of setting the packer tool of claim 1 in a well bore, the method comprising the steps:

(a) locating the packer tool on a work string and abutting a shoulder of the tool on a top of a tubular being run in the well bore;

(b) using the tubular to hold a retaining member of the packer tool in a first position preventing movement of a sleeve of the tool relative to a body of the tool;

(c) running the tool and tubular into a well bore;

(d) detaching the work string from the tubular and raising the tool relative to the tubular;

(e) locating the retaining member above the top of the tubular so that it moves to a second position releasing the tool body and providing a contact surface; and (f) landing the contact surface on the top of the tubular so that the sleeve is arrested and movement of the tool body compresses packing elements on the body which set the tool.

16. A method of performing an integrity test on a well completion, the method comprising the steps:

(a) locating a retrievable packer at a polished bore receptacle of a tieback packer on a work string;

(b) running the work string in a well bore;

(c) setting the tieback packer at a desired location within the well bore;

(d) setting the retrievable packer to isolate a section of the well bore;

(e) circulating a light density fluid through the work string and monitoring the pressure to determine the integrity; and (f) removing the work string and retrievable packer from the well bore.

17. A method as claimed in claim 16 wherein the integrity test is an in-flow or negative pressure test.

18. A method as claimed in claim 16 wherein the step of setting the retrievable packer includes the step of setting down the retrievable packer on the polished bore receptacle.

19. A method as claimed in claim 18 wherein the method includes the step of detaching the work string from the tieback packer and polished bore receptacle prior to setting the retrievable packer.

20. A method as claimed in claim 16 wherein the method includes the step of pulling up the work string after setting the tieback packer and before setting the retrievable packer.

21. A method as claimed in claim 16 wherein the retrievable packer is a compression set packer.

22. A method as claimed in claim 21 wherein the compression set packer is according to claim 1.

23. A packer tool for mounting on a work string, the packer tool comprising a body with one or more packer elements and a sleeve, the packer tool being set by movement of the tool body relative to the sleeve compressing the one or more packer elements, wherein the sleeve includes at least one retaining member, the/each retaining member located in an aperture between an inner and an outer surface of the sleeve;

and wherein the sleeve includes restraining lips or overhangs on the inner and outer surfaces at the/each aperture to limit movement of the/each retaining member as it protrudes from the aperture;

and further wherein the at least one retaining member is moveable between first and second positions, the first position preventing movement of the sleeve relative to the tool body and the second position releasing the tool body while providing means for arresting movement of the sleeve so that the tool can be set.

24. A packer tool for mounting on a work string, the packer tool comprising a body with one or more packer elements and a sleeve, the packer tool being set by movement of the tool body relative to the sleeve compressing the one or more packer elements, wherein the sleeve includes at least one sprung dog, the at least one sprung dog being moveable between first and second positions, the first position preventing movement of the sleeve relative to the tool body and the second position releasing the tool body while providing means for arresting movement of the sleeve so that the tool can be set, and wherein a spring of the/each dog biases the/each dog to the second position.

25. A packer tool for mounting on a work string, the packer tool comprising a body with one or more packer elements and a sleeve, the packer tool being set by movement of the tool body relative to the sleeve compressing the one or more packer elements, wherein the sleeve includes at least one retaining member, the at least one retaining member being moveable between first and second positions, the first position preventing movement of the sleeve relative to the tool body and the second position releasing the tool body while providing means for arresting movement of the sleeve so that the tool can be set, and wherein the tool body includes at least one recess on an outer surface into which is located the/each retaining member in the first position.

26. A packer tool for mounting on a work string, the packer tool comprising a body with one or more packer elements and a sleeve, the packer tool being set by movement of the tool body relative to the sleeve compressing the one or more packer elements, wherein the sleeve includes at least one retaining member, the/each retaining member located in an aperture between an inner and an outer surface of the sleeve;

wherein the at least one retaining member is moveable between first and second positions, the first position preventing movement of the sleeve relative to the tool body and the second position releasing the tool body while providing means for arresting movement of the sleeve so that the tool can be set;

and wherein a second portion of the/each retaining member protrudes from the aperture in the first position and includes a contact surface to engage a formation in the well bore when the/each retaining member is in the second position.

27. A packer tool for mounting on a work string, the packer tool comprising a body with one or more packer elements and a sleeve, the packer tool being set by movement of the tool body relative to the sleeve compressing the one or more packer elements, wherein the sleeve includes at least one retaining member, the at least one retaining member being moveable between first and second positions, the first position preventing movement of the sleeve relative to the tool body and the second position releasing the tool body while providing means for arresting movement of the sleeve so that the tool can be set, wherein the tool body and the sleeve include one or more ports which are aligned when the packer is set to allow the passage of fluid from an outer surface of the sleeve to a throughbore of the tool body.

28. A method of setting a packer tool in a well bore, the packer tool comprising a body with one or more packer elements and a sleeve, the packer tool being set by movement of the tool body relative to the sleeve compressing the one or more packer elements, wherein the sleeve includes at least one retaining member, the at least one retaining member being moveable between first and second positions, the first position preventing movement of the sleeve relative to the tool body and the second position releasing the tool body while providing means for arresting movement of the sleeve so that the tool can be set, the method comprising the steps:

(a) locating the packer tool on a work string and abutting a shoulder of the tool on a top of a tubular being run in the well bore;

(b) using the tubular to hold the at least one retaining member of the packer tool in the first position preventing movement of the sleeve of the tool relative to the body of the tool;

(c) running the tool and tubular into a well bore;

(d) detaching the work string from the tubular and raising the tool relative to the tubular;

(e) locating the at least one retaining member above the top of the tubular so that it moves to the second position releasing the tool body and providing a contact surface; and (f) landing the contact surface on the top of the tubular so that the sleeve is arrested and movement of the tool body compresses the one or more packer elements on the body which set the tool.

29. A method of performing an integrity test on a well completion, the method comprising the steps:

(a) locating a retrievable compression set packer tool at a polished bore receptacle of a tieback packer on a work string, the retrievable compression set packer tool comprising a body with one or more packer elements and a sleeve, the packer tool being set by movement of the tool body relative to the sleeve compressing the one or more packer elements, wherein the sleeve includes at least one retaining member, the at least one retaining member being moveable between first and second positions, the first position preventing movement of the sleeve relative to the tool body and the second position releasing the tool body while providing means for arresting movement of the sleeve so that the tool can be set;

(b) running the work string in a well bore;

(c) setting the tieback packer at a desired location within the well bore;

(d) setting the retrievable compression set packer tool to isolate a section of the well bore;

(e) circulating a light density fluid through the work string and monitoring the pressure to determine the integrity; and (f) removing the work string and retrievable compression set packer tool from the well bore.

* * * * *